US009716328B2

(12) United States Patent
Yoon

(10) Patent No.: US 9,716,328 B2
(45) Date of Patent: Jul. 25, 2017

(54) FLEXIBLE FLAT CABLE FOR LOW VOLTAGE DIFFERENTIAL SIGNALING

(71) Applicant: EUNSUNG INDUSTRIAL INC., Puchon-shi, Kyonggi-Do (KR)

(72) Inventor: Sang bo Yoon, Bucheon-si (KR)

(73) Assignee: EUNSUNG INDUSTRIAL INC., Puchon-shi, Kyonggi-Do (KR)

( * ) Notice: Subject to any disclaimer, the term of this patent is extended or adjusted under 35 U.S.C. 154(b) by 0 days.

(21) Appl. No.: 14/792,277

(22) Filed: Jul. 6, 2015

(65) Prior Publication Data

US 2016/0005510 A1 Jan. 7, 2016

(30) Foreign Application Priority Data

Jul. 7, 2014 (KR) ..... 10-2014-0084761

(51) Int. Cl.
*H01B 7/08* (2006.01)
*H01R 13/02* (2006.01)

(52) U.S. Cl.
CPC ..... *H01R 13/025* (2013.01)

(58) Field of Classification Search
CPC ..... H01B 7/08
USPC ..... 174/117 F, 117 FF
See application file for complete search history.

(56) References Cited

U.S. PATENT DOCUMENTS 3,601,755 A * 8/1971 Shiells ..... H05K 3/4092 439/492
5,206,462 A * 4/1993 Iura ..... H01R 43/0228 174/117 A
5,509,204 A * 4/1996 Sadigh-Behzadi .. H05K 3/4092 174/117 F
5,527,997 A * 6/1996 Saen ..... B21B 1/166 174/117 FF
5,700,979 A * 12/1997 Lewis ..... H05K 1/118 174/117 F
2012/0097421 A1* 4/2012 Gundel ..... H01B 7/0861 174/113 R
2012/0276772 A1* 11/2012 Yaguchi ..... H01R 13/5804 439/493
2013/0037303 A1* 2/2013 Wang ..... H01R 13/025 174/117 FF

FOREIGN PATENT DOCUMENTS

JP 08-171953 * 7/1996

* cited by examiner

*Primary Examiner* — Chau N Nguyen
(74) *Attorney, Agent, or Firm* — Birch, Stewart, Kolasch & Birch, LLP

(57) ABSTRACT

A flexible flat cable for low voltage differential signaling, includes upper and lower insulating films, and conductive lines interposed between the upper and lower insulating films and arranged at a predetermined pitch in parallel to each other. Each conductive line includes a central part having a circular sectional surface and a rolled part having flat upper and lower surfaces, which are formed by performing a rolling process with respect to an end portion of the central portion, and subject to a heat treatment process, end portions of rolled parts are arranged at a predetermined pitch and exposed to an outside to form a terminal part, a predetermined number of conductive lines interposed between the upper and lower insulating films are grouped in a strip, and a cutting line is formed while passing through the upper insulating film, a space between strips, and the lower insulating film.

12 Claims, 11 Drawing Sheets

FLEXIBLE FLAT CABLE FOR LOW VOLTAGE DIFFERENTIAL SIGNALING

BACKGROUND OF THE INVENTION

1. Field of the Invention

The present invention relates to a flexible flat cable for low voltage differential signaling (LVDS), and more particular to a flexible flat cable including a conductive line having a circular sectional surface at a central part thereof, and flat upper and lower surfaces at a terminal part thereof.

2. Description of the Related Art

U.S. Patent Application No. 2013-0037303 discloses "flexible flat cable". The flexible flat cable includes a plurality of conductive lines arranged in parallel and an insulating layer to cover the conductive lines. The flexible flat cable disclosed in U.S. Patent Application No. 2013-0037303 has cutting lines to divide the conductive lines covered with the insulating layer into several strips and stack the conductive lines to reduce the width of the flexible flat cable. However, in the conductive line, the terminal part is formed by pressing a terminal part of a metallic wire having a circular sectional surface through a rolling process and making the terminal part of the metallic wire flat, and exposed to the outside.

Accordingly, when wiring is performed between electronic devices using the flexible flat cable, the stacked part of the conductive line has a circular sectional surface so that the stacked part of the conductive line has flexibility, and the connection part of the conductive line has a flat surface in order to improve rolling workability and securely ensure the connection when connecting the electronic devices with each other.

A flat cable employing a conductive line having a flat terminal part formed by pressing a terminal part of a metallic wire having a circular sectional surface through a rolling process is disclosed in Japanese Unexamined Patent Publication No. 2010-192287. The flat cable disclosed in Japanese Unexamined Patent Publication No. 2010-192287 has a structure in which conductive lines having circular sectional surfaces are arranged in parallel, upper and lower portions of the conductive lines are covered with insulators, terminal parts of the conductive lines are exposed, and the exposed terminal parts of the conductive lines having the circular sectional surfaces are pressed through the rolling process, so that the terminal part have the upper and lower surfaces.

In addition, a structure in which flat terminal parts are formed by pressing conductive lines having a circular section surface through the rolling process and arranged in parallel is disclosed in Japanese Unexamined Patent Publication No. 2002-56721. According to Japanese Unexamined Patent Publication No. 2002-56721, a user may arbitrarily select a conductor having a circular sectional surface or a flat conductor for use.

U.S. Patent Application No. 2012-0205138 discloses a flexible flat cable in which terminal parts of conductive lines having circular sectional surfaces are pressed through the rolling process so that flat terminal parts are formed and the conductive lines are arranged in parallel. According to the flexible flat cable of U.S. Patent Application No. 2012-0205138, before covering conductive lines having circular sectional surfaces, which are arranged in parallel, with upper and lower insulating films, portions of the conductive lines having the circular sectional surfaces are pressed through rolling process so that flat portions of the conductive lines are formed and exposed at an end of the flexible flat cable, and upper and lower insulating films are covered on the conductive lines.

If the rolling process is performed to make a metallic wire having a circular sectional surface flat, a part of the metallic wire subject to the rolling process loses the inherent flexibility of the metallic wire and becomes rigid. The terminal part that loses the flexibility and becomes rigid may have a low bending characteristic, that is, low flexibility. Accordingly, when the terminal part is bent, the terminal part may be easily broken. If the terminal part is broken, a signal cannot be exactly transmitted, so that a device cannot be operated or the operating error of the device may occur. In particular, a flexible flat cable having a terminal to be directly inserted into a connector without a PCB substrate may more severely represent the above phenomenon. In order to remove the above problems, the terminal part must have a predetermined degree or of flexibility. A pure copper wire requires 10% or more of flexibility and 0.2 kgf or more tension.

SUMMARY OF THE INVENTION

The present invention provides a flexible cable in which a stacked part of a conductive line has flexibility when wiring is performed between several electronic devices using the flexible cable, and a terminal part of the conductive line pressed through the rolling process has a flat surface with a flexibility recovered to an original flexibility of a conductive line.

The present invention provides a flexible cable in which a stacked part of a conductive line has flexibility when wiring is performed between several electronic devices using the flexible cable, a terminal part of the conductive line pressed through the rolling process has a flat surface with a flexibility recovered to an original flexibility of a conductive line, and an internal part of the flexible cable is divided into several strips so that the strips are stacked one another.

In order to accomplish the above object, there is provided a flexible flat cable including an upper insulating film and a lower insulating film, and conductive lines interposed between the upper and lower insulating films and arranged in parallel to each other while being spaced apart from each other by a predetermined pitch. Each conductive line comprises a central part having a circular sectional surface and a rolled part having a flat upper surface and a flat lower surface, which are formed by performing a rolling process with respect to an end portion of the central portion, and subject to a heat treatment process, end portions of rolled parts are spaced apart from each other by a predetermined pitch and exposed to an outside to form a terminal part, and a predetermined number of conductive lines interposed between the upper and lower insulating films are grouped in a strip, and a cutting line is formed while passing through the upper insulating film, a space between strips, and the lower insulating film.

In the above structure, a circular sectional surface part and the terminal part may extend in a form of a linear line.

In the above constitution, the conductive line may include the central part having the circular sectional surface, a transition part extending from the central part, and a linearly-extending part extending from the transition part. An end portion of the linearly-extending part is subject to the rolling process to form the terminal part. A section of the flexible flat cable in which the cutting line is formed is referred to a cutting section, and the end portion of the linearly-extending part serves as an electrically connecting part, so that the linearly-extending part is referred to a connection section. A transition section is interposed between the cutting section and the connection section.

Several conductive lines provided in the cutting section are gathered to constitute one group, and the cutting line is formed between groups. The pitch between the groups is 1.0 mm, and the cutting line passes a part corresponding to the half of the pitch. A strip includes a group of conductive lines separated from each other by the cutting line. Strips may be overlapped with each other and tied by a binding unit. The overlapped strips may be freely bendable regardless of directions.

As described above, according to the present invention, the flat portion of the metallic wire formed by performing the rolling process with respect to the metallic wire having the circular sectional surface is subject to heat treatment, so that the flexibility of the metallic wire is recovered to an original flexibility, thereby preventing the terminal part of the metallic wire from being broken when the terminal part is inserted into the connector.

In the above constitution, the reinforcement plate is attached under the transition section and the connection section. The reinforcement plate facilitates the insertion of the flexible flat cable into the connector.

According to the present invention, after performing the rolling process with respect to the conductive line in order to make the metallic wire having the circular sectional surface flat, the portion of the conductive line subject to the rolling process is heated so that the flexibility of the rolled portion is recovered to the original flexibility or the approximate flexibility of the rolled portion. Accordingly, when the terminal part is inserted into the connector, the terminal part can be prevented from being broken.

DETAILED DESCRIPTION OF THE INVENTION

Hereinafter, the first embodiment of the present invention will be described.

Figure 1:
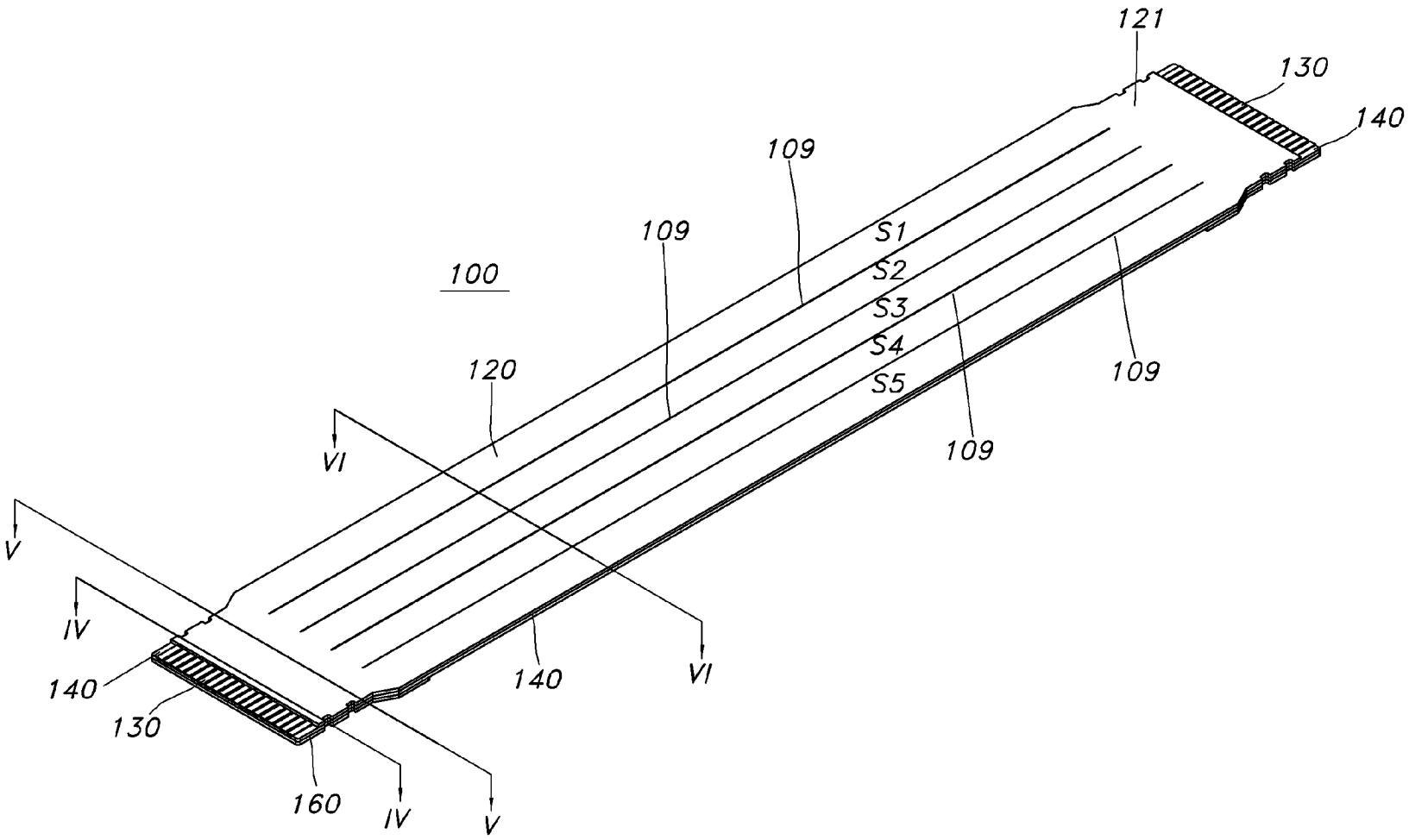
FIG. 1 is a perspective view showing a flexible flat cable according to the present invention.
Figure 2:
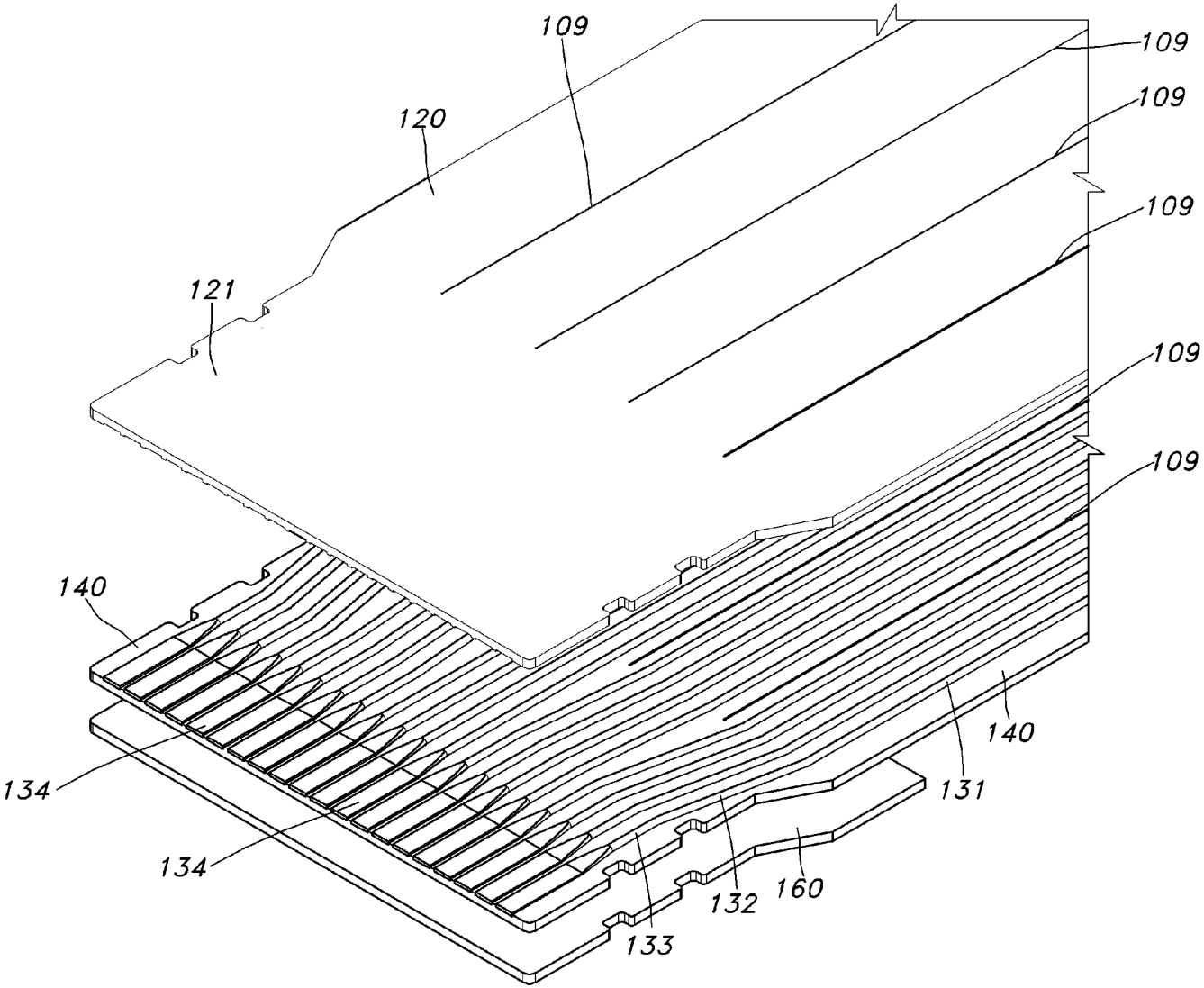
FIG. 2 is a partial exploded perspective view showing a portion of the flexible flat cable according to the first embodiment of the present invention.
Figure 3:
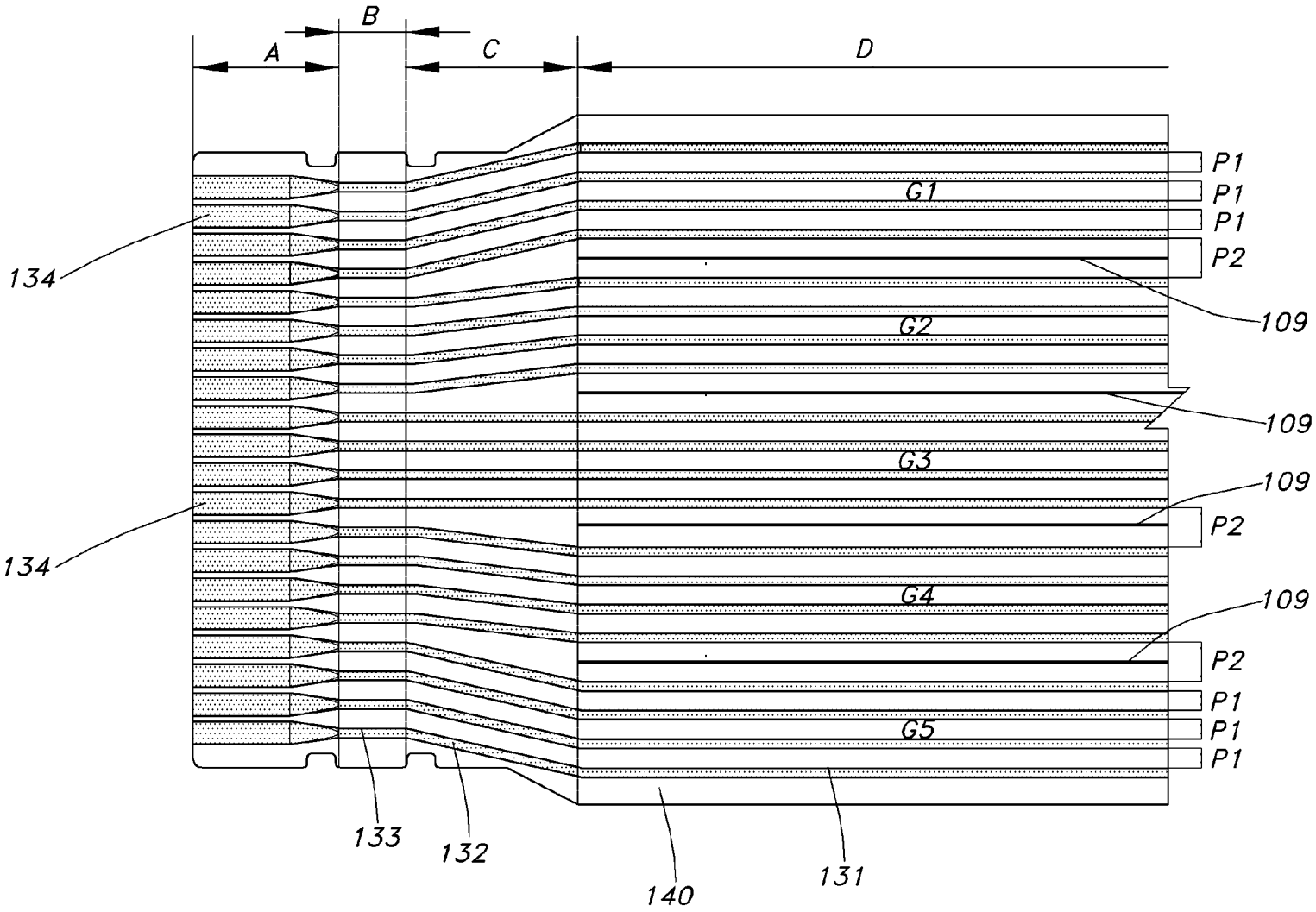
FIG. 3 is a partial plan view showing the arrangement of conductive lines in the flexible flat cable according to the first embodiment of the present invention.

Referring to FIG. 1, a flexible flat cable 100 having a substantially rectangular shape includes an upper insulating film 120, a lower insulating film 140 bonded with the upper insulating film 120, and a plurality of conductive lines 130 interposed between the upper and lower insulating films 120 and 140. The upper insulating film 120 has a width equal to that of the lower insulating film 140, but has a length shorter than that of the lower insulating film 140, so that a portion of a terminal part of a conductive line interposed between the upper and lower insulating films 120 and 140 may be exposed. The flexible flat cable 100 is provided at an end portion thereof with a reduction part 121 having a width equal to that of a connector 400 so that the reduction part 121 is fitted into the connector 400, and a portion of a terminal part 134 of the conductive line is exposed to the outside an the end portion of the reduction part 121. The exposed terminal part 134 is fitted into the connector 400 to be electrically connected with a cable or a connection terminal coupled to the connector 400. The flexible flat cable 100 is formed at an inner part thereof with cutting lines 109 extending lengthwise, so that the flexible flat cable 100 is divided into a plurality of strips S1 to S5 to be stacked one another. Hereinafter, a section formed in the flexible flat cable 100 by the cutting line 109 is referred to as a cutting section for the convenience of explanation. FIG. 2 is a partial exploded perspective view showing the flexible flat cable 100 according to the present invention. FIG. 3 is a plan view partially showing the structure that the conductive lines are provided on the lower insulating film 140.

Referring to FIGS. 2 and 3, conductive lines interposed between the upper and lower insulating films 120 and 140 have central portions extending in the form of a linear line and arranged in parallel to each other. The conductive lines arranged in parallel are divided into several groups G1 to G5. In the groups G1 to G5, the central portions D of the conductive lines extending in the form of a linear line are arranged at an equal pitch P1, and a pitch P2 between the groups is two times wider than the pitch P1 between the conductive lines in one group (P2=P1×2). In detail, the pitch P2 between the groups is two times wider than the pitch P1 between the conductive lines in one group, so that the cutting line 109 can be easily formed.

For example, the flexible flat cable may have a constant pitch of 05 mm between the conductive lines in one group. In this case, since the pitch between the conductive lines is significantly narrow, the cutting line 109 may not be formed. Therefore, the cutting line is formed by forming a pitch of 1.0 mm between adjacent conductive lines provided in different groups.

However, when the conductive lines are arranged at a pitch of 0.5 mm therebetween in one group, and the groups are arranged at a pitch of 1.0 mm therebetween, the pitch between terminal parts of the conductive lines is not constant. Accordingly, in order to constantly form the pitch between the terminal parts of the conductive lines, the shape of the conductive lines may be deformed and arranged to overcome the above problem.

In other words, the conductive lines are arranged in parallel to each other in the cutting section D having the cutting lines, and a transition section C extending from the conductive lines arranged in parallel to each other is provided, so that all conductive lines extending from the cutting section D are gathered while forming a predetermined pitch therebetween and then extend in the form of a linear line, so that the terminal parts of the conductive lines are arranged at a constant pitch in a linear line section B. A portion of the linear line section B extending in the form of the linear line is subject to a rolling process, so that the upper and lower surfaces become flat to form the terminal parts 134.

Figure 4:
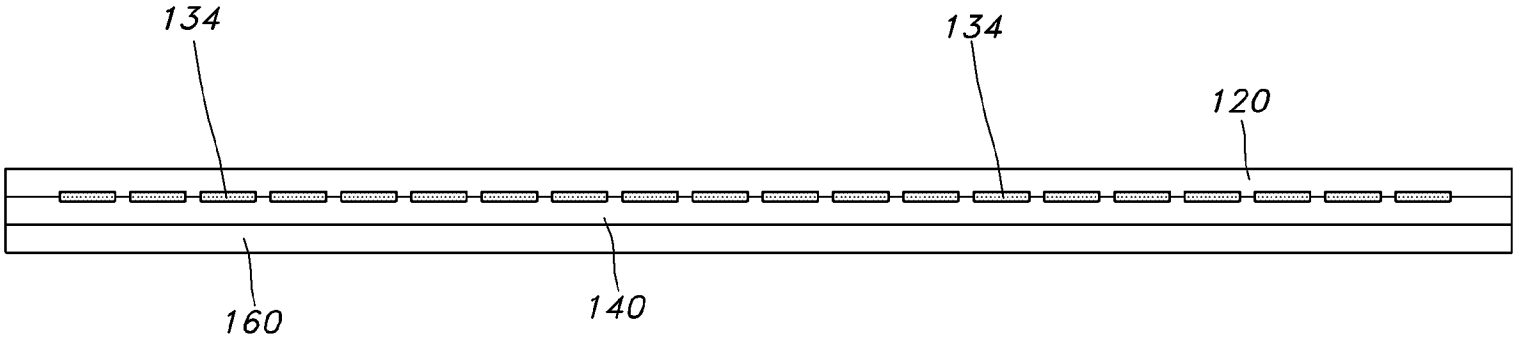
FIG. 4 is a left side sectional view taken along line IV-IV of FIG. 1.
Figure 5:
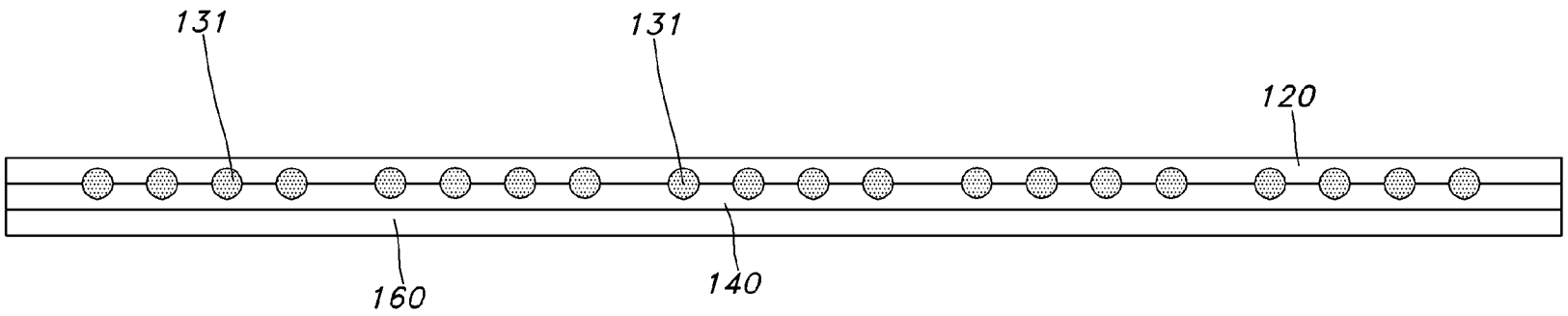
FIG. 5 is a left side sectional view taken along line V-V of FIG. 1.
Figure 6:
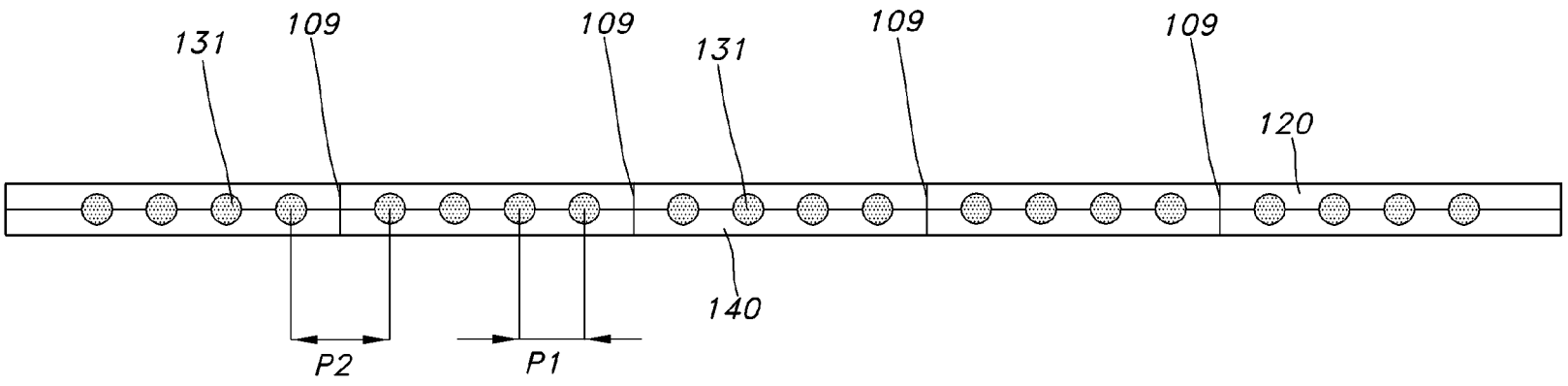
FIG. 6 is a left side sectional view taken along line VI-VI of FIG. 1.

FIGS. 4 to 6 are left side sectional views taken along relevant lines of FIG. 1.

FIG. 4 shows the shape of the flexible flat cable in which a portion of a linear line section B extending in the form of a linear line is subject to the rolling process so that upper and lower surfaces of the portion subject to the rolling process become flat, so terminal parts are maintained at a constant pitch.

FIG. 5 shows the shape of the flexible flat cable in which the pitch between the conductive lines is narrowed in the transition section extending in the form of a linear line.

FIG. 6 shows the shape of the flexible flat cable in which the conductive lines are arranged at the pitch of P1 therebetween in one group, and the groups are arranged at the pitch P2 (=P1×P2) therebetween.

Figure 7:
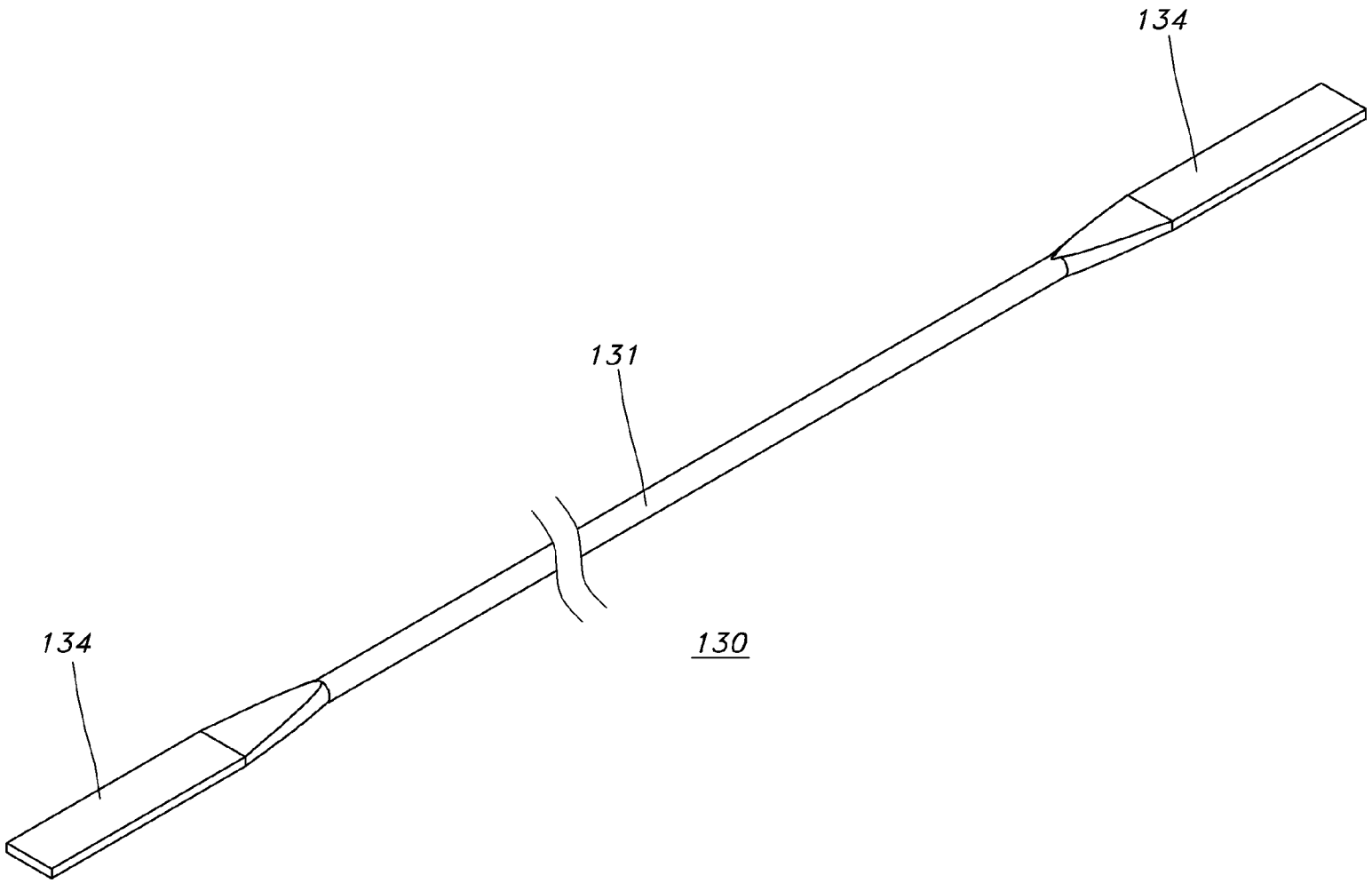
FIG. 7 is an enlarged view showing a conductive line according to the present invention.

FIG. 7 is a view showing the conductive line 130 interposed between the upper and lower insulating films 120 and 140. The conductive line 130 includes a central portion 131 subject to pre-treatment to have a circular sectional surface and at least partially extending in the form of a linear line and the terminal part 134 having the flat upper and lower surfaces formed by pressing both end portions of the conductive line 130 extending from the central portion 131 through the rolling process. An end portion of the terminal part 134 having the flat upper and lower surfaces is fitted into a connector in a final product to serve as an electrical connection terminal. In order to prevent the end portion of the terminal part 134 from being broken when being fitted into the connector, the end portion of the terminal part 134 is subject to the heat treatment so that the flexibility is provided for the end portion of the terminal part 134.

An enhancement film 160 is attached under the lower insulating film of the terminal parts serving as the electrical connection terminal as the conductive lines are exposed.

Hereinafter, the second embodiment will be described.

Figure 8:
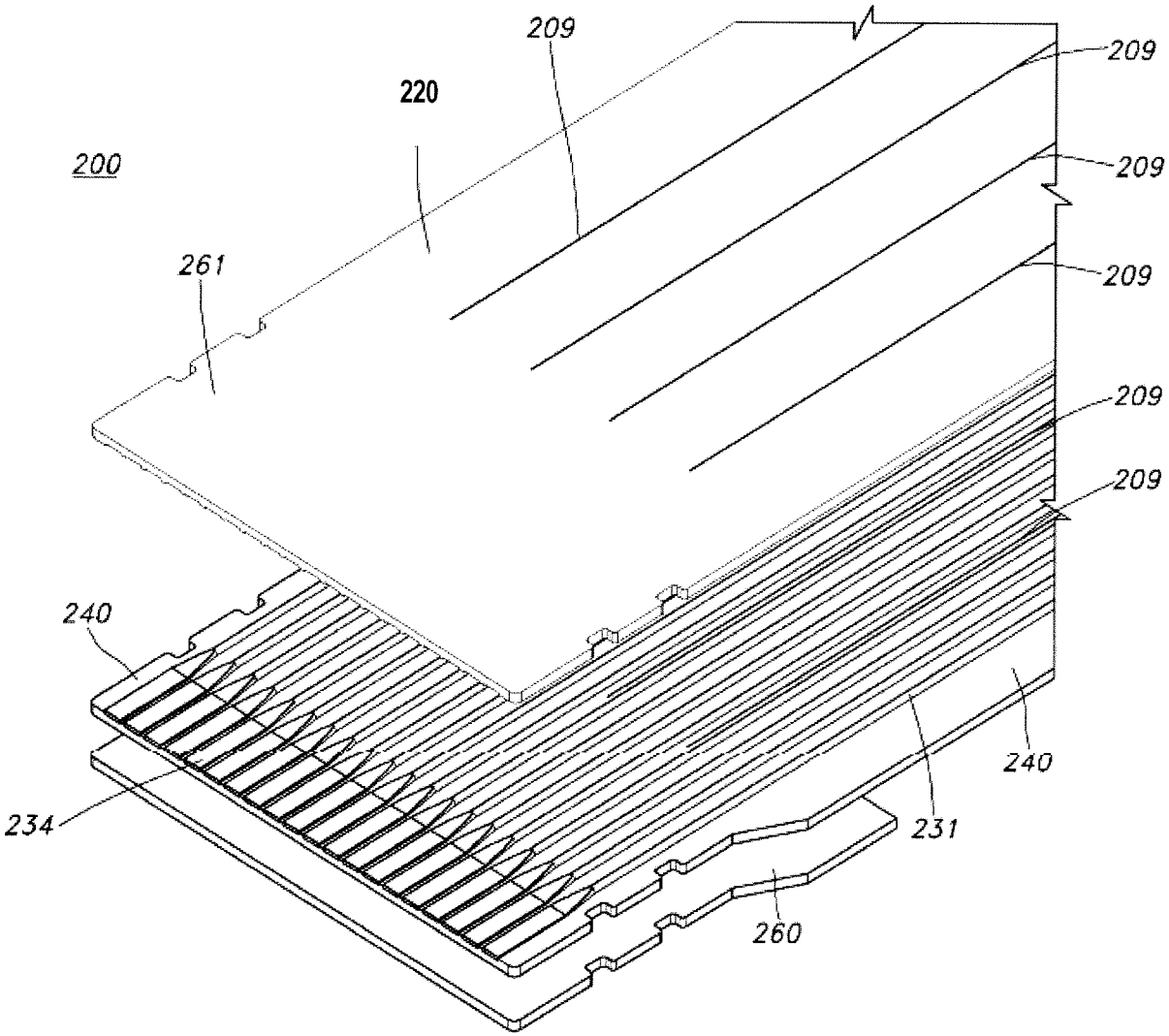
FIG. 8 is a partial exploded perspective view showing the flexible flat cable according to the second embodiment of the present invention.

Referring to FIG. 8, a flexible flat cable 200 having a substantially rectangular shape includes an upper insulating film 220, a lower insulating film 240 bonded with the upper insulating film 220, and a plurality of conductive lines interposed between the insulating film 220 and the lower insulating film 240.

As shown in FIG. 8, the conductive line interposed between the upper and lower insulating films 220 and 240 includes a central portion subject to pre-treatment to have a circular sectional surface and at least partially extending in the form of a linear line and a terminal part having the flat upper and lower surfaces formed by pressing both end portions of the conductive line extending from the central portion through the rolling process. An end portion of the terminal part having the flat upper and lower surfaces is fitted into a connector in a final product to serve as an electrical connection terminal. In order to prevent the end portion of the terminal part from being broken when being fitted into the connector, the end portion of the terminal part is subject to the heat treatment so that the flexibility is provided for the end portion of the terminal part.

The upper insulating film 220 has a width equal to that of the lower insulating film 240, but has a length shorter than that of the lower insulating film 240, so that a portion of a terminal part of a conductive line interposed between the upper and lower insulating films 220 and 240 may be exposed to the outside. The exposed terminal parts of the conductive lines serve as electrical connection terminals.

Figure 9:
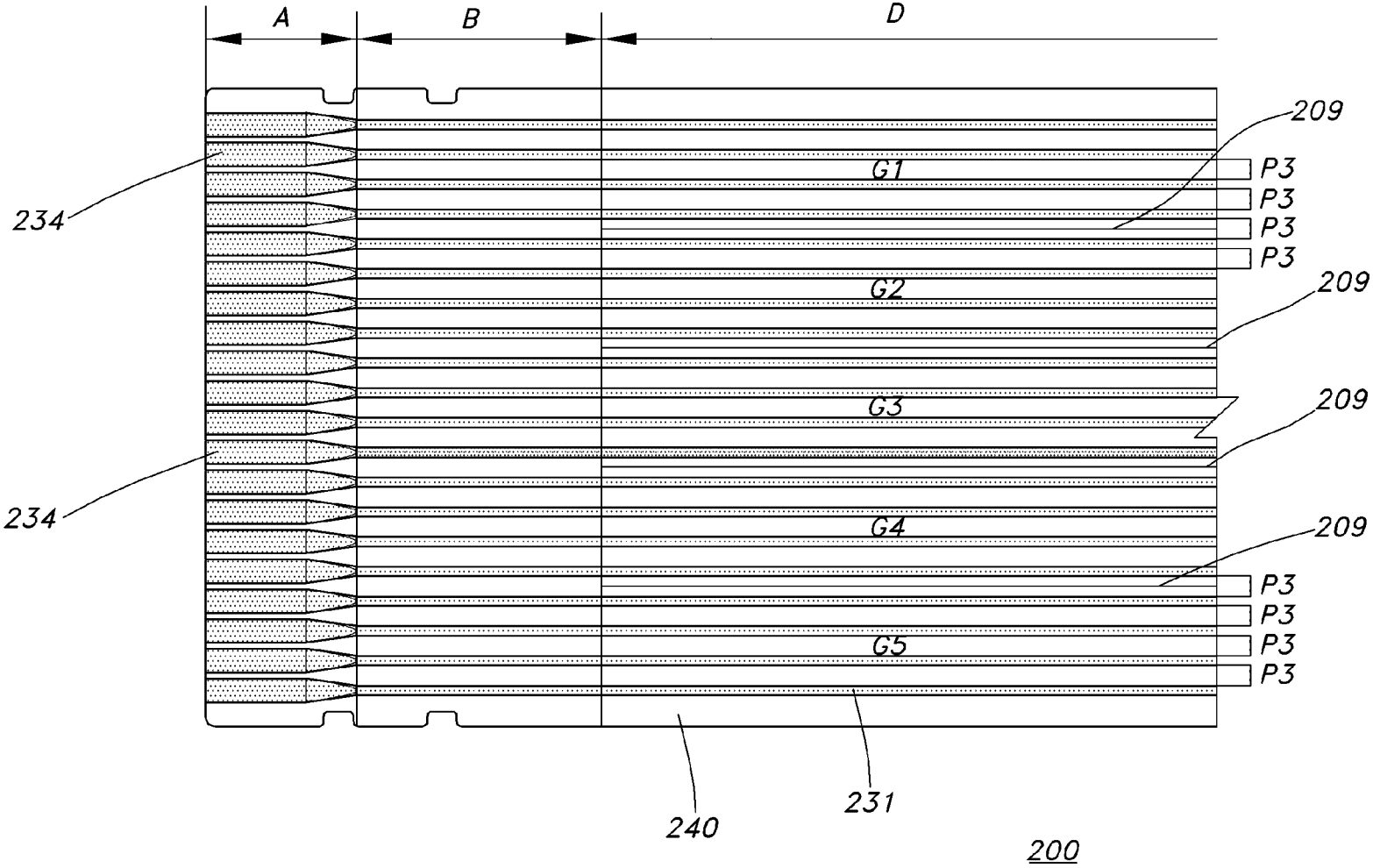
FIG. 9 is a partial plan view showing the arrangement of conductive lines in the flexible flat cable according to the second embodiment of the present invention.

The conductive lines interposed between the upper and lower insulating films 220 and 240 are arranged so that the central portions extending in the form of a linear line are parallel to each other while maintaining at an equal pitch P3. The conductive lines arranged in parallel to each other are divided into several groups. For example, as shown in FIG. 9, since the pitch between the conductive lines is 1.0 mm, it is unnecessary to widen the pitch between the conductive lines in order to form the cutting line 209 differently from the first embodiment.

The upper insulating film 220 is formed at an inner part thereof with a cutting line extending lengthwise. The cutting line passes through the upper insulating film 220, the space between the groups, which is parallel to the linear portion of the conductive line while extending in the form of a substantially linear line, and a portion of the lower insulating film of the conductive line, which extends in the form of a substantially linear line. The inner parts of the flexible cables may be divided into several strips by the cutting line, and a group of conductive lines is provided in each strip.

The terminal parts of the conductive lines are arranged at a predetermined pitch and exposed to the outside.

An enhancement film 260 is attached under the lower insulating film of the terminal parts serving as the electrical connection terminal as the conductive lines are exposed.

Hereinafter, a method for manufacturing the flexible flat cable will be described.

Figure 10:
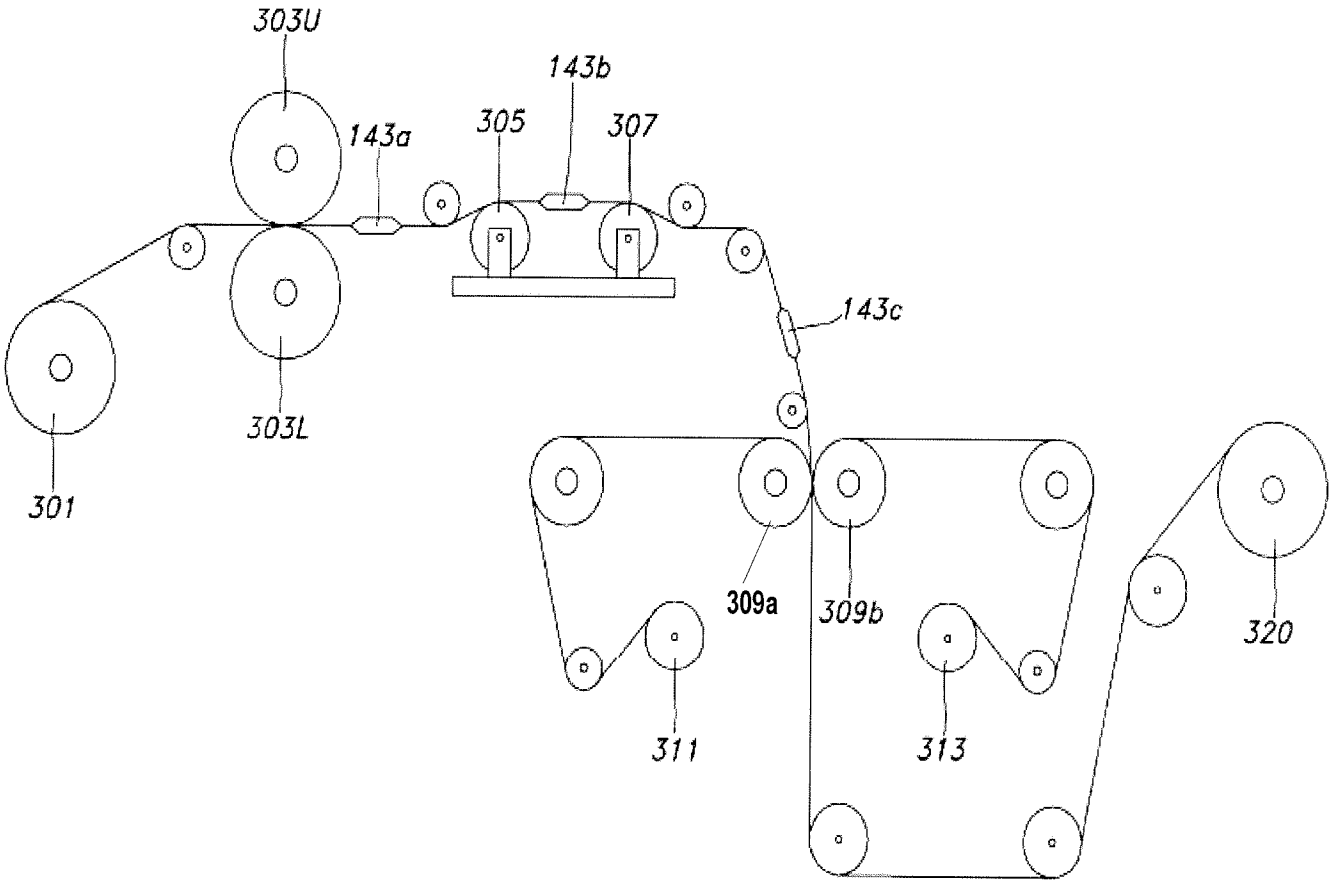
FIG. 10 is a view showing one embodiment of a device to perform heat treatment with respect to a portion subject to the rolling process.

A device for manufacturing the flexible flat cable is shown in FIG. 10. In FIG. 10, conductive lines having the circular sectional view are released from a re-winding bobbin 301 while being arranged in parallel to.

The conductive lines released from the bobbin 301 for the conductive line are partially subject to the rolling process at positions for the terminal parts while passing through the space between rollers 303U and 303L, so that terminal parts 134 having flat upper and lower surfaces are formed. The conductive lines partially subject to the rolling process to include the terminal parts having the flat upper and lower surfaces are heated while passing through the space between a plus (+) electrode roller 305 and a minus (−) electrode roller 307. The heated conductive lines are supplied to bonding rollers 309*a* and 309*b* and gradually cooled in the air, so that the flexibility lost in the rolling process can be recovered to the original flexibility of a conductive line.

The conductive line having the original flexibility, which has been recovered, is supplied to the space between an upper insulating film released from an upper insulating film re-winding roller 311 and a lower insulating film released from a lower insulating film re-winding roller 313 so that the conductive line is bonded to the upper and lower insulating films by the bonding rollers 309*a* and 309*g*. A product having the conductive line interposed between the upper and lower insulating films is wound around a winding roller 320. The product wound around the winding roller 320 is cut in a required length while a cutting line is formed in the product through the subsequent process.

Figure 11:
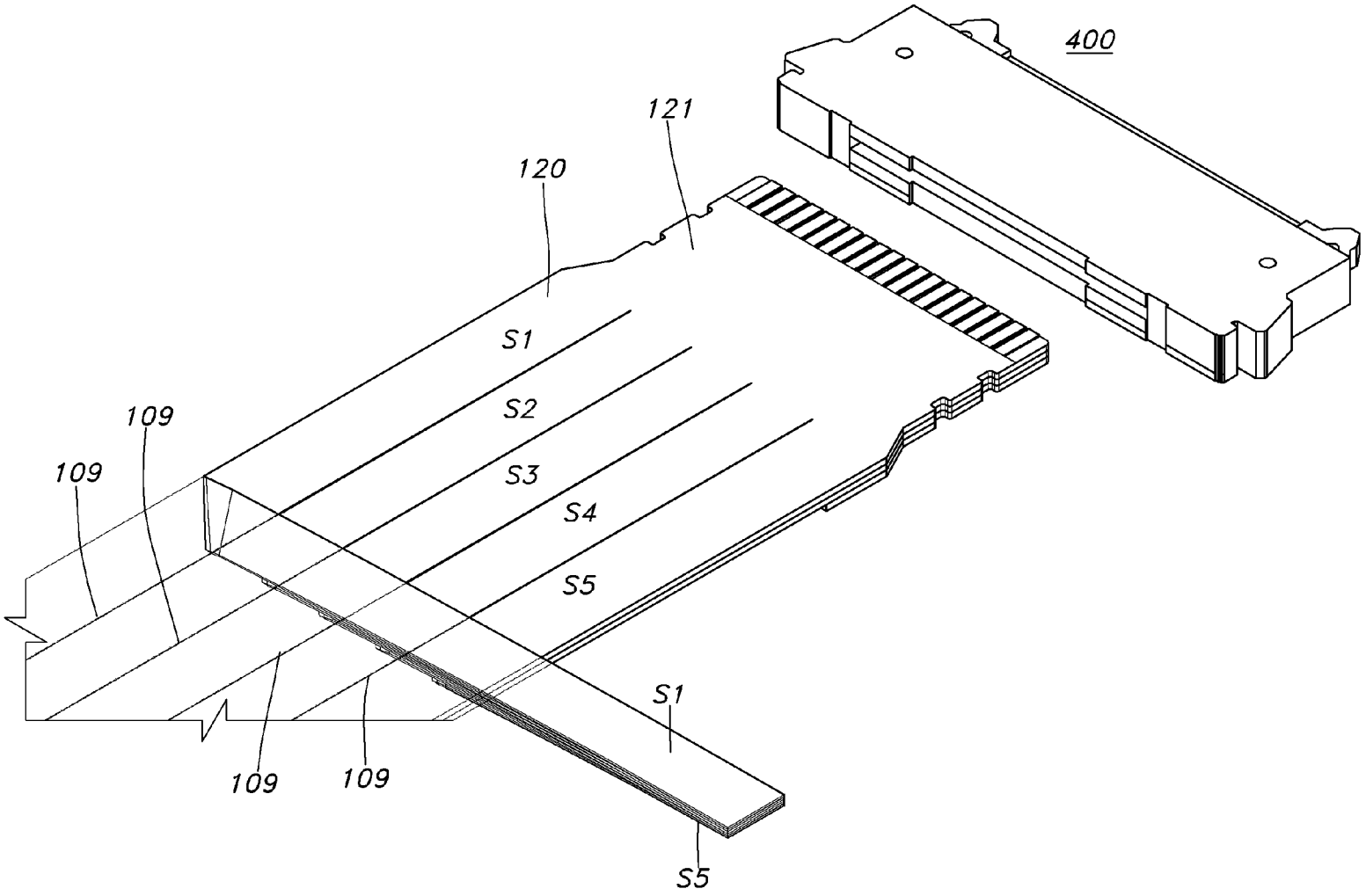
FIG. 11 is a view showing the stack structure of strips separated from each other by a cutting line between conductive line groups in a cutting section.

FIG. 11 shows the stack structure of strips separated from each other by a cutting line 109 between conductive line groups in a cutting section.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A flexible flat cable comprising:

an upper insulating film and a lower insulating film;

conductive lines interposed between the upper and lower insulating films and arranged in parallel to each other while being spaced apart from each other by a predetermined first pitch, wherein each of the conductive lines comprises a central part having a circular sectional surface and a heat-treated rolled part having a flat upper surface and a flat lower surface; and an enhancement film attached under the lower insulating film around the heat-treated rolled part for serving as an electrical connection terminal, wherein end portions of the rolled part are spaced apart from each other by a predetermined second pitch and exposed to an outside to form a terminal part, wherein a predetermined number of the conductive lines interposed between the upper and lower insulating films are grouped in strips, and each group is spaced apart from each other by a predetermined third pitch larger than the first pitch, and wherein the first pitch is larger than the second pitch.

2. The flexible flat cable of claim 1, wherein the central part and the terminal part extend in a form of a linear line.

3. The flexible flat cable of claim 1, wherein the conductive lines are arranged in parallel to each other while being spaced apart from each other by a pitch of 1.0 mm.

4. The flexible flat cable of claim 1, wherein the conductive lines are arranged in parallel to each other while being spaced apart from each other by a first pitch, and the strips are spaced apart from each other by a second pitch is two times larger than the first pitch.

5. The flexible flat cable of claim 1, wherein each of the conductive lines further comprises a linearly-extending part extending from the central part having the circular sectional surface through a transition part interposed between the linearly-extending portion and the central part, and the linearly-extending part is subject to the rolling process to form the terminal part.

6. The flexible flat cable of claim 5, wherein the conductive lines are arranged in parallel to each other while being spaced apart from each other by a first pitch of 0.5 mm, and the strips are spaced apart from each other by a second pitch of 1 mm.

7. A method of manufacturing a flexible flat cable, the method comprising:

providing an upper insulating film and a lower insulating film;

providing conductive lines interposed between the upper and lower insulating films and arranged in parallel to each other while being spaced apart from each other by a predetermined first pitch;

performing a rolling process with respect to end portions of a central part of the conductive lines having a circular sectional surface to form a rolled part having a flat upper surface and a flat lower surface; and performing a heat treatment of the rolled part to increase flexibility of the conductive lines, wherein an enhancement film is attached under the lower insulating film around the heat-treated rolled part to serve as an electrical connection terminal, wherein end portions of the rolled part are spaced apart from each other by a predetermined second pitch and are exposed to an outside to form a terminal part, wherein a predetermined number of the conductive lines interposed between the upper and lower insulating films are grouped in strips, and each group is spaced apart from each other by a predetermined third pitch larger than the first pitch, and wherein the first pitch is larger than the second pitch.

8. The method of claim 7, wherein the central part and the terminal part extend in a form of a linear line.

9. The method of claim 7, wherein the conductive lines are arranged in parallel to each other while being spaced apart from each other by a pitch of 1.0 mm.

10. The method of claim 7, wherein the conductive lines are arranged in parallel to each other while being spaced apart from each other by a first pitch, and the strips are spaced apart from each other by a second pitch which is two times larger than the first pitch.

11. The method of claim 7, wherein each of the conductive lines further comprises a linearly-extending part extending from the central part through a transition part interposed between the linearly-extending portion and the central part, and the linearly-extending part is subject to the rolling process to form the terminal part.

12. The method of claim 7, wherein the conductive lines are arranged in parallel to each other while being spaced apart from each other by a first pitch of 0.5 mm, and the strips are spaced apart from each other by a second pitch of 1 mm.

* * * * *